United States Patent [19]

Pringle et al.

[11] Patent Number: 4,601,341

[45] Date of Patent: Jul. 22, 1986

[54] FLEXIBLE PISTON WELL SAFETY VALVE

[75] Inventors: Ronald E. Pringle; William D. Eatwell, both of Houston, Tex.

[73] Assignee: Camco, Incorporated, Houston, Tex.

[21] Appl. No.: 713,080

[22] Filed: Mar. 18, 1985

[51] Int. Cl.[4] ..... E21B 34/10

[52] U.S. Cl. ..... 166/321; 166/332; 92/137

[58] Field of Search ..... 166/319, 321, 324, 332; 251/62; 92/120, 137, 178

[56] References Cited

U.S. PATENT DOCUMENTS

| | | | |
|---|---|---|---|
| 3,965,802 | 6/1976 | Jacobs | 92/137 X |
| 4,161,219 | 7/1979 | Pringle | 166/324 |
| 4,444,266 | 4/1984 | Pringle | 166/321 X |
| 4,452,310 | 6/1984 | Pringle et al. | 166/319 |
| 4,467,705 | 8/1984 | Reist | 92/137 |
| 4,467,870 | 8/1984 | Langham | 166/321 |
| 4,484,511 | 11/1984 | Dibrell | 92/120 X |
| 4,495,908 | 1/1985 | Pringle | 166/321 |
| 4,503,913 | 3/1985 | Carmody | 166/319 |
| 4,527,630 | 7/1985 | Pringle | 166/321 |

*Primary Examiner*—James A. Leppink
*Assistant Examiner*—John F. Letchford
*Attorney, Agent, or Firm*—Fulbright & Jaworski

[57] ABSTRACT

A subsurface well safety valve having a housing with a valve closure member which is controlled by a flow tube which includes an improved hydraulic actuating mechanism. The housing includes a cylinder with a straight portion and a curved portion which is adapted to receive hydraulic fluid from the surface and a piston is movable in the cylinder and connected to the flow tube for moving the flow tube to an open position. The piston includes a metal seal and a flexible portion connected to the top of the metal seal and the flexible portion is adapted to move through the curved portion of the cylinder. A valve and a valve seat are provided in the cylinder above the piston for sealing the hydraulic fluid from the well surface when the valve is open and for engaging and holding the flexible portion and the piston in the open position.

14 Claims, 6 Drawing Figures

FLEXIBLE PISTON WELL SAFETY VALVE

BACKGROUND OF THE INVENTION

It is known to utilize a rod piston in a well safety valve as shown in U.S. Pat. No. 4,161,219 in order to reduce the hydrostatic well pressure acting on the safety valve and thus allow the valve to be used at greater depths. It is also known, as disclosed in patent application Ser. No. 538,000 now U.S. Pat. No. 4,527,630 entitled Hydraulic Actuating Means for Subsurface Well Safety Valves, to utilize a metal piston and seat for providing positive sealing in environments subject to high temperatures and corrosive conditions. However, it is also important that a safety valve have an outside diameter positioned to fit into a well conduit while at the same time having structural thickness and strength to withstand the pressures encountered, particularly the internal or tubing pressure.

The present invention is directed to an improved subsurface well safety valve which has a small cross-sectional piston area for reducing the hydrostatic pressure and allowing the valve to be set at greater depths, as well as having seal means which will withstand a hostile environment and provide a positive seal, and a valve that has a minimum outside diameter while maintaining adequate structural size to withstand high tubing pressure.

SUMMARY

The present invention is directed to a subsurface well safety valve for controlling the fluid flow through a well conduit and includes a housing having a bore and a valve closure member in the bore moving between open and closed positions. A flow tube is telescopically movable in the housing for controlling the movement of the valve closure member. Biasing means are provided acting on the flow tube in a direction for allowing the valve closure member to move to the closed position. An improved hydraulic actuating piston and cylinder means is provided for moving the flow tube in a direction for opening the valve closure member. The housing has a cylinder including a non-straight portion and a port in communication with the cylinder. The port is adapted to receive hydraulic fluid from the well surface. A piston is movable in the cylinder and contacts the flow tube. One side of the piston is in communication with the port for being exposed to hydraulic fluid for moving the flow tube in a direction to open the valve closure member. The piston includes a flexible portion connected to the one side of the piston for moving through the non-straight portion of the cylinder. A valve and valve seat are provided in the cylinder between the port and the one side of the piston for holding the piston in the open position.

A still further object of the present invention is wherein the non-straight portion of the cylinder includes a curved portion.

A still further object is wherein a second valve is provided below the piston for sealing off the pressure in the bore from the cylinder when the valve closure member is closed and a portion of the cylinder is positioned outside of the housing and is not subjected to bore pressure.

Yet a still further object is wherein the valve element is separate from the flexible portion of the piston and wherein the valve element is preferably a ball.

Yet a still further object of the present invention is wherein the valve element has a larger outside size than the outside size of the flexible portion of the piston.

Yet a further object of the present invention is wherein the piston includes a metal seal.

Still a further object of the present invention is wherein the housing has a cylinder with a straight portion and a curved portion and a port adapted to receive hydraulic fluid from the well surface. A piston is movable in the cylinder for moving the flow tube and includes a metal seal movable in the straight portion of the cylinder and includes a flexible portion adapted to move in the straight portion and through the curved portion of the cylinder. A valve and valve seat is provided in the cylinder above the metal seal of the piston for sealing hydraulic fluid from the well surface when the valve is open and for engaging the flexible portion and holding the piston in the open position. A second valve element and valve seal are positioned below the piston for sealing off the cylinder when the valve closure member is closed.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1A:
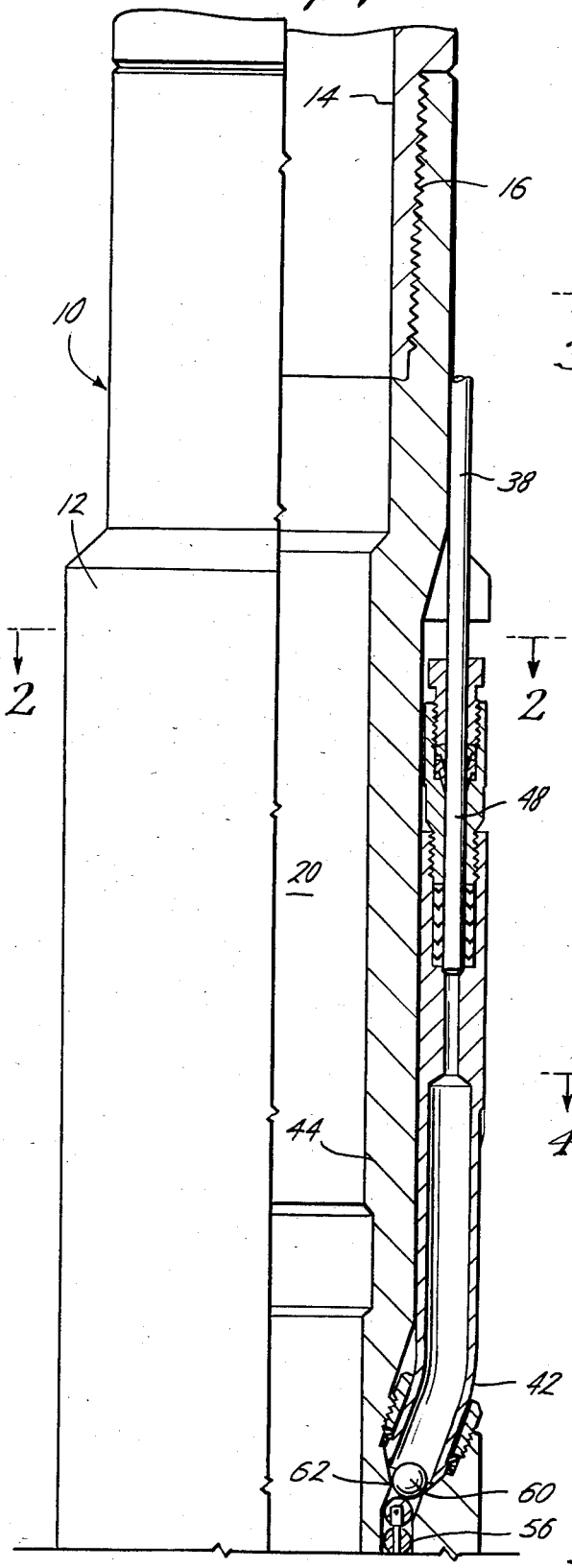
FIGS. 1A, 1B and 1C are continuations of each other and are elevational views, partly in cross section, of one type of safety valve incorporating the present invention in which the valve is shown in the open position.

While the present invention will be described in connection with a subsurface tubing retrievable safety valve having a flapper type valve closure member, for purpose of illustration only, it is understood that the present invention may be used with other types of safety valves and with valves having other types of valve closure members.

Referring now to the drawings, the reference numeral 10 generally indicates the subsurface tubing safety valve of the present invention which includes a housing 12 which is adapted to be connected in a well tubing 14 by threads 16 and 18 at the top and bottom of the housing 12 to permit well production therethrough under normal operating conditions, but in which the safety valve 10 may close or be closed when desired.

The valve 10 includes a bore 20 therethrough, an annular valve seat 22 (FIG. 1C), and a valve closure element such as a flapper valve 24 connected to the body 12 by a pivot pin 26. Thus, when the flapper valve 24 is in the upward position and seated on the valve seat 22, the safety valve 10 is closed blocking flow upwardly through the bore 20 and the well tubing 14.

A flow tube 28 is telescopically movable in the body 12 and through the valve seat 22. As best seen in FIG. 1C, when the flow tube 28 is moved to a downward position, the tube 28 pushes the flapper 24 away from the valve seat 22. Thus, the valve 10 is held in the open position so long as the flow tube 28 is in the downward position. When the flow tube 28 is moved upwardly, the flapper 24 is allowed to move upwardly onto the seat 22 by the action of a spring 30 and also by the action of fluid flow moving upwardly through the bore 20.

The flow tube 28 is biased in an upward direction by any suitable means which may include a spring 32 which acts between a shoulder 34 on the housing 12 and a shoulder 36 on the flow tube 28. Spring 32 yieldably urges the flow tube 28 in an upward direction to release the valve closure member 24 for closing the valve 10. The safety valve 10 is controlled by the application or removal of a pressurized fluid, such as hydraulic fluid, through a controlled path or line such as control line 38 (FIG. 1A) extending to the well surface or the casing annulus.

The present invention is directed to an improved hydraulic actuating means for controlling the movement of the flow tube 28 while (1) providing a structure for reducing the hydrostatic head operating on the safety valve 10 to allow the safety valve to be used at greater depths, (2) a structure which utilizes metal seals instead of elastomer seals allowing the safety valve 10 to be utilized in high temperature and corrosive environments, (3) allows the safety valve 10 to be made of an outside diameter for fitting into small sized well conduits such as casings, and yet providing a sufficient wall thickness and strength to withstand high pressure such as high tubing pressures, (4) the hydraulic acting means is not subjected to collapse by well pressure and therefore can be placed outside the housing, and (5) can be manufactured smaller and less expensive.

Figure 1B:
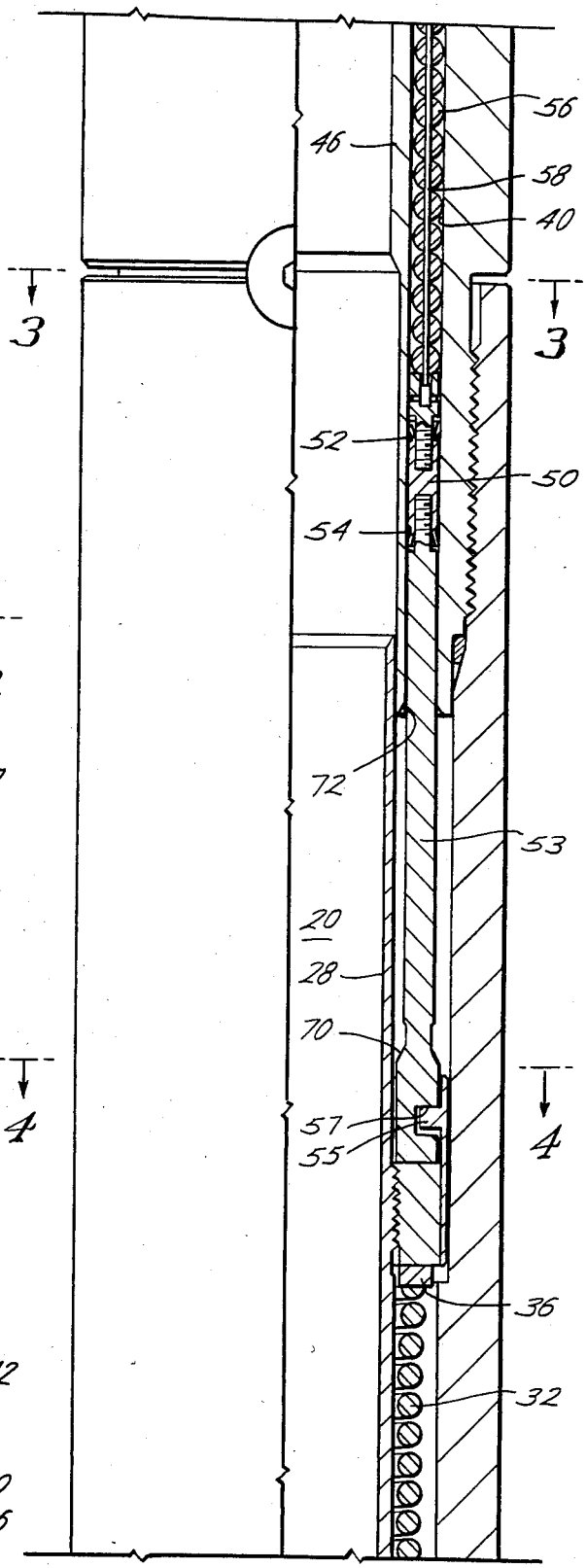
Figure 1C:
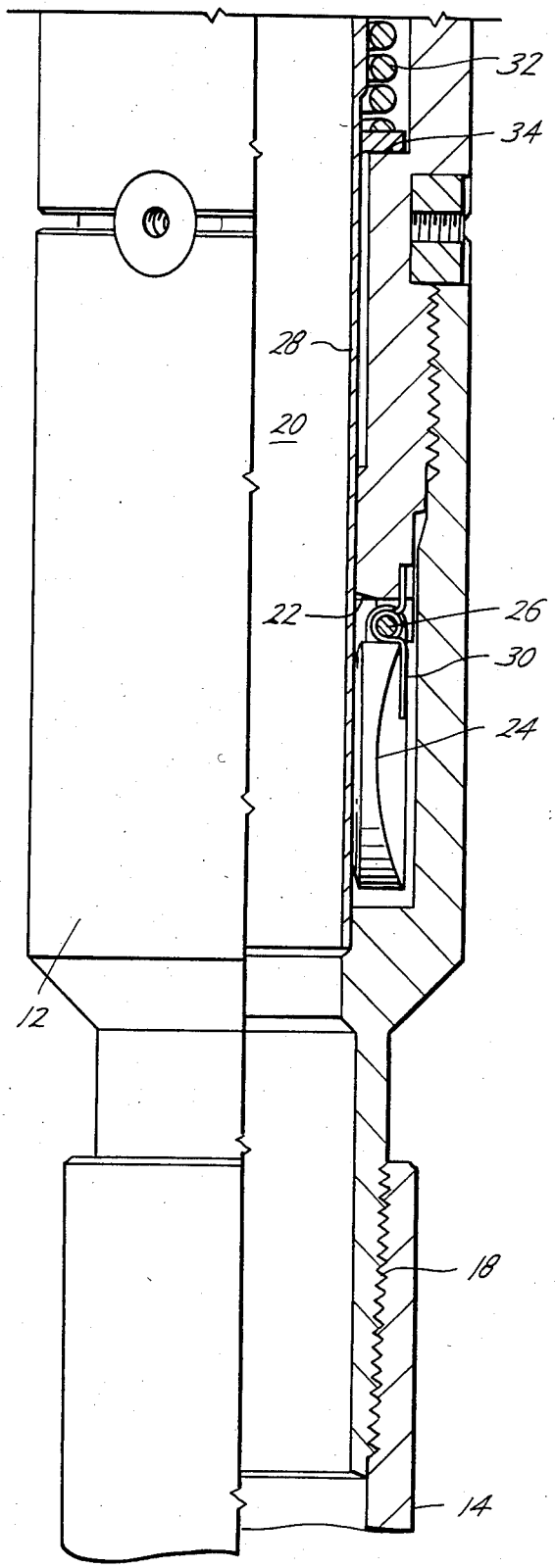
Figure 2:
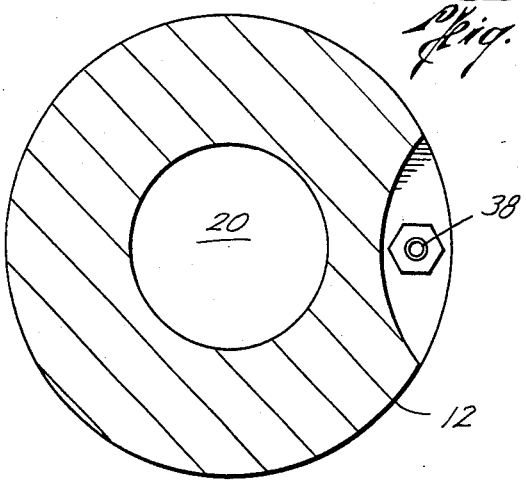
FIG. 2 is a cross-sectional view taken along the lines 2—2 of FIG. 1A.
Figure 3:
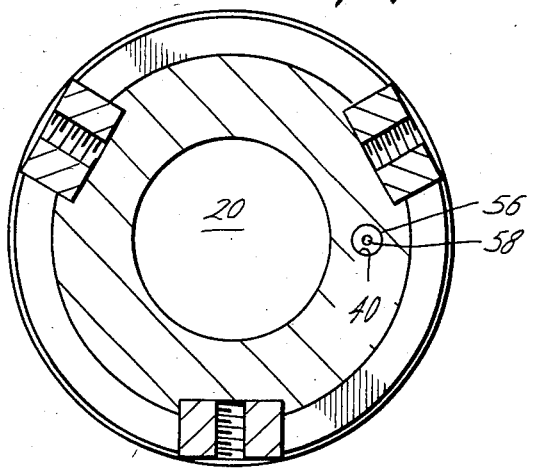
FIG. 3 is a cross-sectional view taken along the lines 3—3 of FIG. 1B.
Figure 4:
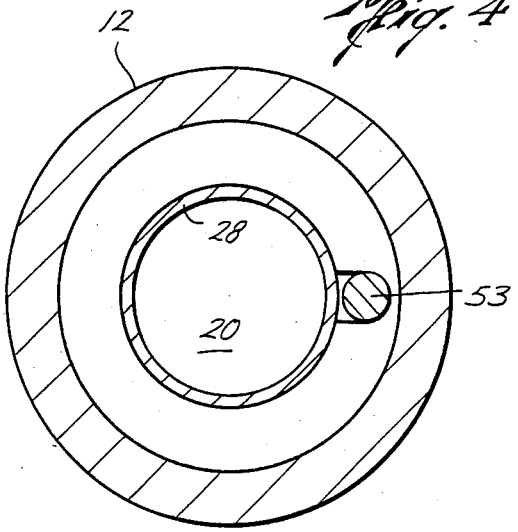
FIG. 4 is a cross-sectional view taken along the lines 4—4 of FIG. 1B.

Referring now to FIGS. 1A and 1B, the housing 12 includes a cylinder having a straight portion 40 and a non-straight portion such as curved portion 42. This unique configuration allows the thickness of the wall portion 44 of the housing 12 to be made sufficiently thick to withstand high tubing pressures, but yet allows the outside diameter of the housing 12 to be made sufficiently small to fit into small sized well conduits such as existing types of well casings. It is also noted that the curved portion 42 of the cylinder is positioned outside of the housing 12 and need not be thick walled as it is not subjected to the well pressure in the bore 20 as will be more fully described hereinafter. This also allows the valve 10 to be made shorter and less expensively. The housing includes a port 48 in communication with the cylinder portion 40 and 42 and with the control line 38 for receiving hydraulic fluid from the well surface.

A piston, preferably a metal piston, 50 having metal cup seals 52 and 54 as more fully described in U.S. patent application Ser. No. 538,000 filed Sept. 30, 1983, now U.S. Pat. No. 4,527,630, may be utilized and is movable in the cylinder portion 40. The piston 50 contacts and is preferably connected to the flow tube 28 by a piston 53 and a tongue 55 and groove 57 connection. The top side of the piston 50 is in communication with the port 48 and thus is exposed to hydraulic fluid in the control line 38 for moving the flow tube 28 downwardly to open the valve closure member 24. While the metal piston 50 will withstand high temperatures and corrosive environments, it is difficult to manufacture metal seals which will seal under all pressure conditions and which will seal against gases. Therefore, a metal valve is provided as will be more fully described hereinafter. The piston includes a flexible portion 56, here shown as a plurality of stainless steel balls connected together by a flexible cable 58 which is secured to the metal piston 50. While the metal piston 50 is positioned to be movable only in the straight portion 40 of the cylinder, the flexible portion 56 may move in both the straight portion 40 and the curved portion 42 of the cylinder. The flexible portion 56 of the piston need not perform any sealing function in the cylinder, but only needs to provide a columnar load to hold the valve in the open position. In fact, the metal piston portion 50 also need not provide a fluid type seal, but only an obstruction to flow sufficient to actuate the flow tube 28. And while the flexible piston portion 56 has been shown as a plurality of connected balls, the balls need not be connected and flexible portion 56 may be of any suitable flexible type members such as a flexible rod or any type of universally movable segmented sections.

Referring now to FIG. 1A, a valve element 60 and a valve heat 62 are provided in the cylinder above the metal piston 50. When hydraulic fluid is supplied to the line 38 and the cylinder, the piston 50 and flow tube 28 will be moved downwardly to open the valve 10. When the valve reaches the open position, the valve element 60, preferably a ball, seats on the seat 62 and positively blocks all further flow of hydraulic fluid through the cylinder thereby conserving hydraulic fluid which might otherwise leak past the metal seal 50 and be lost. With the valve element 60 seated on the valve seat 62, the flexible portion 56 of the piston is held downwardly by the valve element 60 thereby holding the piston 50 downwardly and the flow tube 28 in the open position. It is noted that the outside diameter of the ball valve element 60 is larger than the outside diameter of the flexible portion 56 of the piston to provide a positive seat on a seal. Preferably the ball valve element 60 is separate from the flexible portion 56 of the piston.

Another positive valve is provided below the piston 50. Thus a second valve element 70 and seat 72 (FIG. 1B) is provided with the seat 72 at the bottom of the cylinder and the valve element 70 connected to the piston 50. When the valve 10 moves to the closed position, the element 70 seats on the valve seat 72. Therefore valve element 70, when seated, isolates the cylinder from the high well pressures in the bore 20 and therefore the present invention eliminates the collapse of the containing member of the hydraulic actuating means.

While the piston and cylinder arrangement in the present safety valve 10 can be provided with multiple cylinders and pistons, it is advantageous to provide a single piston and cylinder arrangement which avoids the problem of tolerances encountered in multiple piston safety valves using positive metal seals, it decreases the cost of manufacturing, and reduces the amount of hydrostatic force created by the hydraulic control fluid acting on the piston thereby allowing the valve 10 to be utilized at greater depths and with smaller sized biasing springs 32. This also allows the safety valve 10 to be shorter and therefore less expensive.

In operation, with the safety valve 10 in the closed position, the flow tube 28 would be in the upward position and the piston portions 50 and 56 would be in an upward position with the flexible piston portion 56 extending through the curved portion 42 and the ball valve element 60 would be above and off of the valve seat 62 but valve element 70 would be seated on seat 72. Therefore, when it is desired to open the valve, hydraulic fluid would be applied to the line 38 from the well surface and supplied to the cylinder moving the piston 50 and flexible portion 56 downwardly to move the flow tube 28 through the valve closure member 24 and open the valve 10. When the valve 10 moves to the open position, the ball valve element 60 seats on the seat 62 and is held thereon in a sealing relationship by the hydraulic pressure of the hydraulic fluid in the line 38. The valve element 60 would maintain a downward force on the flexible piston portion 56 and piston 50 to maintain the valve in the open position. When it is desired to close the valve, the hydraulic fluid pressure and the control line 38 is reduced and the biasing means including the spring 32, and the well pressure in the bore 20 which flows around the flow tube 28 and acts on the bottom of the piston 50, will move the piston and the flow tube 28 upwardly allowing the valve closure member 24 to close.

The present invention, therefore, is well adapted to carry out the objects and attain the ends and advantages mentioned as well as others inherent therein. While a presently preferred embodiment of the invention has been given for the purpose for disclosure, numerous changes in the details of construction and arrangement of parts will readily suggest themselves to those skilled in the art and which are encompassed within the spirit of the invention and the scope of the appended claims.

What is claimed is:

1. In a subsurface well safety valve for controlling the fluid flow through a well conduit and including a housing having a bore and a valve closure member in the bore moving between open and closed positions, a flow tube telescopically movable in the housing for controlling the movement of the valve closure member, means for biasing the flow tube in a direction for allowing the valve closure member to move to the closed position, the improvement in means for moving the flow tube in a direction for opening the valve closure member comprising, said housing having a cylinder including a straight and a non-straight portion and a port in communication with the cylinder and adapted to receive hydraulic fluid from the well surface, said non-straight portion being positioned above the straight portion, a piston movable in the cylinder and contacting the flow tube, one side of the piston being in communication with the port for being exposed to hydraulic fluid for moving the flow tube in a direction to open the valve closure member, said piston including a flexible portion and a straight portion, said flexible portion positioned above the straight portion for moving through the non-straight portion of the cylinder, and a valve element and valve seat in the cylinder between the port and said one side of the piston for holding the piston in the open position.

2. The apparatus of claim 1 wherein a portion of the cylinder, in which the flexible portion of the piston moves, is positioned outside of the body.

3. The apparatus of claim 1 wherein the valve element is separate from the flexible portion of the piston.

4. The apparatus of claim 3 wherein the valve element has a larger outside size than the outside size of the flexible portion of the piston.

5. The apparatus of claim 4 wherein the valve element is a ball.

6. The apparatus of claim 1 wherein the non-straight portion of the cylinder includes a curved portion.

7. The apparatus of claim 6 wherein the piston includes a metal cup seal.

8. In a subsurface well safety valve for controlling the fluid flow through a well conduit and including a housing having a bore and a valve closure member in the bore moving between open and closed positions, a flow tube telescopically movable in the housing for controlling the movement of the valve closure member, means for biasing the flow tube upwardly for allowing the valve closure member to move to the closed position, the improvement in means for moving the flow tube downwardly for opening the valve closure member comprising, said housing having a cylinder with a straight portion and a curved portion, said curved portion being positioned above the straight portion, and a port adapted to be in communication with the cylinder and adapted to receive hydraulic fluid from the well surface, a piston movable in the cylinder and connected to the flow tube, one side of the piston being in communication with the port for being exposed to hydraulic fluid for moving the flow tube downwardly for opening the valve closure member, said piston including a flexible portion above the top of a metal seal portion, said flexible portion adapted to move through the curved portion, a first valve element and valve seat in the cylinder above the piston for sealing the hydraulic fluid from the well surface when the valve closure member is opened and for engaging the flexible portion and holding the piston in the open position, and a second valve element and valve seat positioned below the piston for sealing the cylinder from well fluid when the valve closure member is closed.

9. The apparatus of claim 8 wherein a portion of the cylinder, in which the flexible portion of the piston moves, is positioned outside of the housing.

10. The apparatus of claim 8 wherein the first valve element is separate from the flexible portion of the piston.

11. The apparatus of claim 10 wherein the first valve element has a larger outside size than the outside size of the flexible portion of the piston.

12. The apparatus of claim 11 wherein the first valve element is a ball.

13. In a subsurface well safety valve for controlling the fluid flow through a well conduit and including a housing having a bore and a valve closure member moving between open and closed positions for controlling the fluid flow through the bore, a flow tube telescopically moving in the housing for controlling the movement of the valve closure member, and biasing means for moving the flow tube in a direction to close the valve, the improvement in fluid actuating means for actuating the valve closure member, a cylinder connected to the housing, said cylinder including a curved portion and a straight portion, said curved portion positioned above the straight portion, a piston in and movable relative to the cylinder in response to fluid flow between the cylinder and the piston, said piston connected to and moving the flow tube, said piston including a flexible portion positioned above the top of a seal portion, said flexible portion adapted to move through the curved portion of the cylinder, said cylinder on one side of the piston adapted to be in communication with a fluid control passageway, and said cylinder on the second side of the piston adapted to be in communication with a biasing fluid, first and second spaced metal valve seats connected to the cylinder, and first and second metal valve elements which coact with the first and second seats, and said first seat and first valve element positioned to shut off flow from the fluid control passageway to the cylinder when the safety valve is opened, and said second seat and second valve element positioned to shut off flow of the biasing fluid to the cylinder when the safety valve is in the closed position.

14. The apparatus of claim 13 wherein at least a part of the curved portion of the cylinder is positioned outside of the housing.

* * * * *